United States Patent [19]

Kam et al.

[11] Patent Number: 4,647,369

[45] Date of Patent: Mar. 3, 1987

[54] CATALYST DEWAXING PROCESS USING A SLURRY PHASE BUBBLE COLUMN REACTOR

[75] Inventors: Anthony Y. Kam; James C. Kuo; Quang N. Le; Jonah Smith, all of Cherry Hill, N.J.

[73] Assignee: Mobil Oil Corporation, New York, N.Y.

[21] Appl. No.: 848,905

[22] Filed: Apr. 4, 1986

Related U.S. Application Data

[63] Continuation of Ser. No. 744,707, Jun. 14, 1985, abandoned.

[51] Int. Cl.[4] ..... C10G 11/00; C10G 47/24

[52] U.S. Cl. ..... 208/111; 208/112; 208/113; 208/120; 208/146; 208/163

[58] Field of Search ..... 208/108, 111, 112, 113, 208/120, 163, 146

[56] References Cited

U.S. PATENT DOCUMENTS

| | | | |
|---|---|---|---|
| Re. 28,300 | 1/1975 | Butler et al. | 208/120 |
| Re. 28,398 | 4/1975 | Chen | 208/111 |
| 1,922,491 | 8/1933 | Mittasch et al. | 502/349 |
| 2,706,167 | 4/1955 | Harper et al. | 208/213 |
| 2,746,950 | 5/1956 | Lolli | 422/270 |
| 2,987,465 | 6/1961 | Johanson | 208/213 |
| 3,140,322 | 7/1964 | Frilette et al. | 585/270 |
| 3,297,505 | 1/1967 | Garwood et al. | 208/120 |
| 3,453,083 | 7/1969 | Beerli | 422/270 |
| 3,489,675 | 1/1970 | Scott | 208/120 |
| 3,932,269 | 1/1976 | Lehman | 208/157 |
| 3,969,274 | 7/1976 | Frampton | 502/242 |
| 4,158,622 | 6/1979 | Schwarzenbek | 208/213 |
| 4,213,847 | 7/1980 | Chen et al. | 208/111 |
| 4,222,855 | 9/1980 | Pelrine | 208/111 |
| 4,229,282 | 10/1980 | Peters et al. | 208/111 |
| 4,263,126 | 4/1981 | Rollmann | 208/120 |
| 4,317,746 | 3/1982 | Richardson | 502/211 |
| 4,332,670 | 6/1982 | Antal | 208/85 |
| 4,410,416 | 10/1983 | Everman | 422/271 |
| 4,416,766 | 11/1983 | Mulaskey | 208/135 |
| 4,418,235 | 11/1983 | Haag et al. | 585/407 |

*Primary Examiner*—Brian E. Hearn
*Assistant Examiner*—O. Chaudhuri
*Attorney, Agent, or Firm*—Alexander J. McKillop; Michael G. Gilman; James F. Powers, Jr.

[57] ABSTRACT

Dewaxing a waxy feedstock is achieved by dispersing dewaxing catalyst particles within the liquid waxy feedstock and removing gaseous products out of contact with the catalyst by purging a gas stream through the liquid feedstock.

14 Claims, 1 Drawing Figure

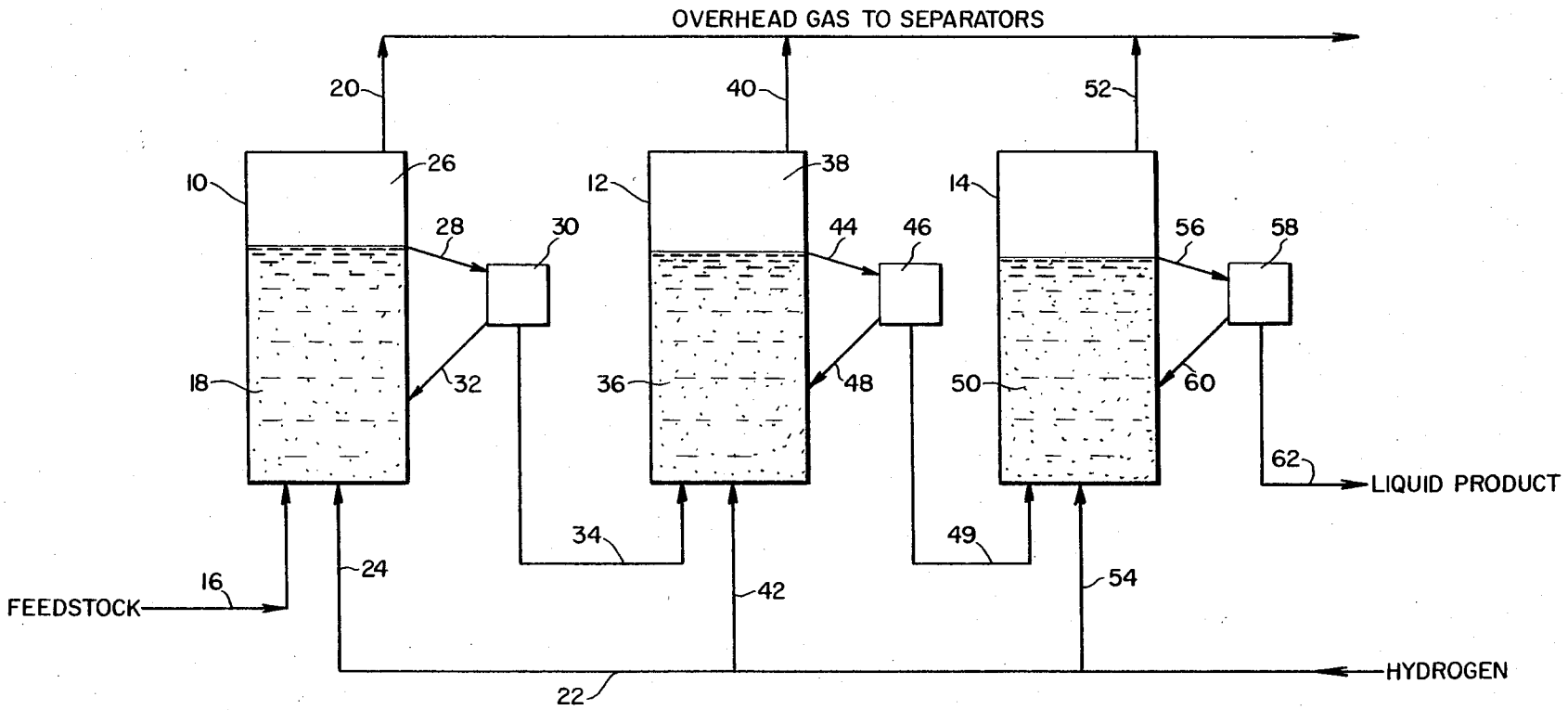
OVERHEAD GAS TO SEPARATORS
LIQUID PRODUCT
HYDROGEN
FEEDSTOCK
10
12
14
16
18
20
22
24
26
28
30
32
34
36
38
40
42
44
46
48
49
50
52
54
56
58
60
62

CATALYST DEWAXING PROCESS USING A SLURRY PHASE BUBBLE COLUMN REACTOR

This is a continuation of copending application Ser. No. 744,707, filed on June 14, 1985 now abandoned.

BACKGROUND OF THE INVENTION

1. Field of the Invention

This invention relates to a novel process for catalytically dewaxing a waxy liquid petroleum feedstock utilizing a shape-selective crystalline zeolite catalyst. More particularly, this invention relates to improvements in the shape-selective dewaxing of liquid petroleum feedstocks to obtain improved product quality, operating efficiency as well as improvements in the aging characteristics of the shape-selective dewaxing catalyst.

2. Prior Art

The cracking and/or hydrocracking of petroleum stocks is in general well known and widely practiced. It is known to use various zeolites to catalyze cracking and/or hydrocracking processes. The cracking may have the intent to convert a certain class of compounds in order to modify a characteristic of the whole petroleum stock. Exemplary of this type of conversion is shape selective conversion of straight and slightly branched aliphatic compounds of 12 or more carbon atoms to reduce pour point, pumpability, and/or viscosity of heavy fractions which contain these waxy constituents. The long carbon chain compounds tend to crystallize on cooling of the oil to an extent such that the oil will not flow, hence may not be able to be pumped or transported by pipelines. The temperature at which such mixture will not flow is designated the "pour point", as determined by standardized test procedures.

The pour point problem can be overcome by shape selective cracking or hydrocracking utilizing principles described in U.S. Pat. No. 3,140,322 dated July 7, 1964. Zeolitic catalysts for selective conversions of wax described in the literature include such species as mordenite, with or without added metal to function as a hydrogenation catalyst.

Particularly effective catalysts for catalytic dewaxing include zeolite ZSM-5 and related porous crystalline aluminosilicates as described in U.S. Pat. No. Re. 28,398 (Chen et al) dated April 22, 1975. As described in that patent, drastic reductions in pour point are achieved by catalytic shape selective conversion of the wax content of heavy stocks with hydrogen in the presence of a dual-functional catalyst of a metal plus the hydrogen form of ZSM-5. The conversion of waxes is by scission of carbon to carbon bonds (cracking) and production of products of lower boiling point than the wax. However, only minor conversion occurs in dewaxing. For example, Chen et al describe hydrodewaxing of a full range shale oil having a pour point of +80° F. to yield a pumpable product of pour point at −15° F. The shift of materials from the fraction heavier than light fuel oil to lighter components was in the neighborhood of 9% conversion.

Current technology for dewaxing petroleum stocks having elevated pour points involves the use of trickle beds whereby gas (primarily hydrogen) and the petroleum stock concurrently flow downward over a bed of solid catalyst. This three-phase trickle bed concept makes use of an intimate mixing between gas and liquid phases while in contact with the catalyst in order to facilitate dewaxing. Performance level of the process is gauged by the length of time during which the process is producing products which meet specifications, as well as the minimum temperature required to attain acceptable products.

In the hydroprocessing of liquid petroleum feedstocks, including heavy feedstocks, e.g., 650° F.+ lube oils, it is desired to remove lighter conversion products from the liquid petroleum flow while concurrently providing a hydrogenative environment for catalytic conversion, which is particularly utilized in the case of the processing of highly waxy feedstocks. Frequently, lighter products which are obtained from cracking and/or hydrocracking reactions compete with the heavier feed molecules for access to the cracking sites in the zeolite or silica-alumina cracking catalysts which are employed in the implementation of the catalytic dewaxing process. Inasmuch as these lighter products diffuse more rapidly into the catalyst than the larger feed molecules, they have a tendency to retard the rate of conversion of the heavier molecules. Moreover, the lighter products also tend to be either more difficult to crack, such as low molecular weight paraffins, or easier to polymerize, such as low molecular weight olefins. They also possess a tendency to coke more readily than their heavier counterparts so as to thereby retard the conversion of the heavier molecules to an even greater extent.

This competition between the light and heavy liquid petroleum molecules is rendered particularly critical when there is employed a catalyst which essentially constitutes a shape-selective zeolite, for example, a zeolite exemplified by ZSM-5 for the dewaxing of liquid petroleum or lube stocks. Processes in reactors which utilize aluminosilicate zeolite catalysts, such as ZSM-5 or other zeolites having smaller pore openings, are disclosed in U.S. Pat. No. 4,222,855 to Pelrine et al and in U.S. Pat. No. Re. 28,398, to N.Y. Chen, both of which are incorporated herein by reference. U.S. Pat. No. 4,263,126 to Rollmann discloses dewaxing a hydrocarbon oil by use of a powdered ZSM-5 catalyst dispersed in the oil undergoing conversion.

Although the utilization of different types of hydroprocessing reactors to implement catalytic dewaxing processes is disclosed in the prior art as exemplified by the above-mentioned U.S. patents, broadly referring to stirring tank-type reactors or trickle bed reactors, there is an obvious need in the technology to more precisely define specific hydroprocessing reactor designs. Needed are reactors which, in a highly efficient and novel manner, will facilitate the removal of the lighter products from the liquid petroleum feedstocks through the intermediary of hydrogen stripping while concurrently preserving an intimate three phase contacting relationship among hydrogen, liquid petroleum feedstock and catalyst.

In copending, commonly assigned U.S. Ser. No. 662,873, filed Oct. 19, 1984, now abandoned, an improved dewaxing process and reactor are disclosed for hydrodewaxing lube oils in which process and reactor the dewaxing catalyst is submerged as a bed in the liquid phase of the oil being dewaxed. In this process, the submerged bed of catalyst can be rotated and hydrogen gas bubbled through the liquid to facilitate removing the resultant cracked gaseous products from contact with the dewaxing catalyst as quickly as possible. Additionally, an interfacial area between the liquid and gas phases is made as large as possible to allow rapid devolution of the cracked gaseous products into a free gas phase above the liquid oil phase.

SUMMARY OF THE INVENTION

In this invention, catalyst dewaxing of paraffin feedstocks is carried out in the slurry phase in which the dewaxing catalyst is in the form of particles freely movable within the liquid oil. A bubble column reactor is utilized in which the catalyst is suspended in the liquid paraffinic feedstock and hydrogen is bubbled through the liquid feed. Gaseous products are removed from the top of the reactor.

In a modification of the above process, liquid product can be removed from the reactor, any catalyst suspended in the product returned to the reactor via separation and the liquid product fed to a second reactor. This multiple staging process reduces the amount of liquid feedstock which remains untreated relative to the use of a single bubble column reactor.

BRIEF DESCRIPTION OF THE DRAWING

The FIGURE is a schematic diagram of a multistage slurry phase reactor for catalytic dewaxing of a paraffinic feedstock in accordance with this invention.

DETAILED DESCRIPTION

Pursuant to particular features of the process of this invention, one type of useful reactor for the dewaxing process is essentially a vertical reactor, preferably of the cylindrical type, wherein the dewaxing catalyst is dispersed and freely movable within the liquid paraffinic feedstock which enters the reactor at the bottom. In this regard, the present invention is different from the previously mentioned commonly assigned, copending application in which the dewaxing catalyst while submerged in the liquid oil phase is essentially an anchored bed of catalyst.

Feedstocks which vary widely in their wax content can be dewaxed accordingly to the process of this invention. One group of such oils is that which contains sufficient waxes to impart an undesirably high pour point. In general, such oils have a substantial fraction, i.e. at least about 10 vol. %, which distills above 350° F. These oils as a group will be referred to herein as "waxy" oils, and include virgin petroleum crudes and fractions thereof such as kerosene, jet fuel, light gas oil, heavy gas oil, fuel oils, and atmospheric and vacuum tower residua. Feedstocks which have been previously hydrotreated or hydrogenated and which consequently contain little or no sulfur can also be dewaxed by this process. The liquid feedstock to be dewaxed preferably is a lube oil which has a boiling point between 650° F. and 1300° F., a pour point about 80°–120° F. and a sulfur content about 0.1–3.0 wt. %. Shale oil, oil from tar sands and waxy syncrudes from coal may also be dewaxed in accordance with this invention.

While the liquid feedstock is in contact with the catalyst, the catalyst is either uniformly dispersed within the liquid feedstock as in the form of a fluidized bed within the liquid, i.e. slurry phase or the catalyst is supported such as on the bottom of the reactor or on trays within the reactor, but still freely movable within the liquid feedstock, albeit in a more concentrated condition within the liquid oil, i.e. ebullated bed. Preferably, hydrogen or other hydrocarbon-free gas is injected into the bottom of the column so that the gas flows upwardly through the feedstock to mix and ebullate the catalyst within the feedstock. The gas products that are generated in the dewaxing operation are collected at the topmost portion of the reactor which is maintained in a free open configuration so that the hydrocarbon gas bubbling through the liquid can enhance the degasification of the liquid oil phase. The dewaxed oil product is withdrawn at a point removed from any supported section of the reactor and at a lower level in the reactor than the free open space for gas removal.

Typical dewaxing conditions include contacting the feedstock with the dewaxing catalyst at about 500° to 1100° F., space velocity at about 0.1 to 100 LHSV, and hydrogen to hydrocarbon mole ratio of about 0 to 20, and a pressure of about 100 to 3,000 psig.

The dewaxing catalyst which is utilized is preferably a shape-selective crystalline zeolite catalyst, preferably a metal exchanged ZSM-5, although other similar zeolites may also be suitably employed as a catalyst material.

The shape-selective catalysts most preferred are intermediate pore size crystalline aluminosilicate zeolites characterized by a constraint index of about 1–12. Such zeolites include ZSM-5, ZSM-11, ZSM-12, ZSM-23, ZSM-35, ZSM-38, ZSM-48 and other similar materials.

ZSM-5 is described in greater detail in U.S. Pat. No. 3,702,886, and the entire contents of which is incorporated herein by reference.

ZSM-11 is described in U.S. Pat. No. 3,709,979. That description is incorporated in its entirety herein by reference.

ZSM-12 is described in U.S. Pat. No. 3,832,449. That entire description is incorporated herein by reference.

ZSM-23 is described in U.S. Pat. No. 4,076,842. The entire content thereof is incorporated herein by reference.

ZSM-35 is described in U.S. Pat. No. 4,016,245. The description of that zeolite, in its entirety, is incorporated herein by reference.

ZSM-38 is more particularly described in U.S. Pat. No. 4,046,859, the entire description of which is incorporated herein by reference.

ZSM-48 is described in U.S. Pat. No. 4,375,573 and its entire description of ZSM-48 is incorporated herein by reference.

The zeolites used as catalysts in this invention may be in the hydrogen form or they may be base exchanged or impregnated to contain ammonium or a metal cation complement.

The catalyst particle size is smaller relative to the catalyst-supported extrudates used in trickle bed operation or in the stirred tank configuration proposed in the aforementioned commonly assigned application. In this invention the catalyst must have a particle size which allows the catalyst to be movable and dispersed within the liquid oil phase. Accordingly, when a slurry phase operation is used in which the dewaxing catalyst is substantially uniformly dispersed within the liquid oil phase, a particle size of about 0.001 to 300 microns is applicable. When an ebullated bed is used in which the catalyst is supported within the reactor but movable within the liquid oil above the support, a larger particle size is used, about 100 to 3000 microns.

The important feature of the catalyst configuration within the reactor is that the catalyst is completely submerged in the petroleum liquid being dewaxed and that the reactor is designed to minimize the contact time between the catalyst and the product gases which are formed during the dewaxing step. In general, the reactor types suitable in the present invention are slurry-phase reactor systems in which the dewaxing catalyst is submerged, dispersed, mixed or ebullated within the hydrocarbon fraction to be dewaxed. A gas is bubbled through the slurry to provide movement of the catalyst within the hydrocarbon oil and increase liquid-catalyst contact and to further strip the gaseous products from the catalyst, thus reducing overcracking of paraffins, polymerization of gaseous olefins, and, in general, reducing the competition to catalyst sites between the gaseous molecules and the heavy waxy components of the feedstock. It is important that the reactor include a sufficient open space area above the liquid in order to effectively remove the gaseous products from liquid undergoing dewaxing. Ebullated bed reactors in which the catalyst particles are supported on trays and the like although freely moveable in the liquid hydrocarbon and slurry-phase bubble column reactors in which the catalyst is uniformly dispersed through the liquid phase, and similar reactor types are useful in this invention. Thus, in the catalytic dewaxing of a high pour point hydrocarbon fraction such as a lube oil, i.e. 650° F.+, using a bubble column reactor, the liquid feed is pumped into the bottom of the column and mixes with converted liquid which has the dewaxing catalyst dispersed therein. Liquid product can be removed at any of several points along the column, depending on desired conversion. The suspended catalyst can be separated from the liquid product by filtering. Hydrogen is bubbled into the slurry to provide hydrogen for conversion and to suspend the catalyst in the reaction medium. As discussed previously, the hydrogen aids in removing cracked products. The hydrogen and overhead product leave the column at the top and proceed to product separators. The slurry bubble column reactor has the advantage of providing a uniform temperature profile throughout the reactor. This can be very important in reducing the aging of the dewaxing catalyst, since it has been found that aging can be slowed by operating within a relatively low narrow temperature range as described in the aforementioned copending U.S. application. Moreover, the slurry bubble column is simple as well as flexible to operate and has low maintenance requirements.

While any reactor configuration which will allow free dispersal of the dewaxing catalyst within the liquid feedstock to be dewaxed is applicable in the present invention, it is preferred to use a multistage reactor to insure that substantially all of the liquid feedstock is converted. This multistage system for a slurry bubble column reactor is illustrated in the FIGURE, although the multistage reactor system is also applicable for ebullated beds in which the catalyst while freely mobile throughout the liquid feedstock is more concentrated and not as uniformly distributed as in the slurry phase system. Referring to the FIGURE, a three stage slurry phase reactor system is shown comprising slurry bubble columns 10, 12, and 14. Liquid waxy feedstock is fed to the bottom of slurry reactor 10 via line 16. The liquid feedstock mixes with the slurry 18 which comprises the dewaxing catalyst uniformly dispersed within the feedstock undergoing conversion within slurry reactor 10. Gaseous products which are formed leave the top of slurry reactor 10 via line 20. Preferably, the gaseous products which are formed are stripped from slurry 18 by bubbling a gas through the slurry. As shown in the FIGURE, hydrogen gas from line 22 enters the bottom of each of slurry reactors 10, 12, and 14. Thus, hydrogen gas via lines 22 and 24 enters the bottom of slurry reactor 10 and escapes through line 20 with the cracked gaseous products from reactor 10. Free space 26 within slurry reactor 10 also facilitates the separation of the gaseous products from the dewaxing catalyst. As stated previously, the removal of the gaseous products from contact with the dewaxing catalyst avoids overcracking and in some cases polymerization, both reactions of which degrade the composition of the product. Liquid product is preferably removed from reactor 10 at a location near the interface of slurry 18 and the open space 26 and is removed from slurry reactor 10 via line 28. Liquid product via line 28 is fed to separator 30 wherein the catalyst particles are filtered from the dewaxed product which may still contain some unreacted feedstock. The catalyst which is removed is returned to slurry 18 via line 32. The specific means of separating the catalyst from the liquid product is not critical to the invention, and any type of separation device, including fine mesh filters would be applicable. Liquid product which leaves separator 30 via line 34 is again introduced into the bottom of the second slurry reactor 12 where unreacted feedstock is dewaxed within slurry 36. Slurry reactor 12 is equivalent to slurry reactor 10 containing a free space 38 above slurry 36 to facilitate removal of gaseous products which leave the top of slurry reactor 12 via line 40. Hydrogen gas from lines 22 and 42 supply sufficient hydrogen gas to strip the gaseous product from the catalyst and slurry 36. Liquid product is obtained at the top of slurry 36 via line 44 where it is passed to separator 46 and the separated catalyst particles returned to the slurry 36 via line 48. The cycle is repeated again wherein liquid product from separator 46 enters the bottom of the third stage slurry reactor 14 via line 48 whereupon the liquid is dispersed within slurry 50. Gaseous products are removed from the top of slurry reactor 14 via line 52 wherein the gaseous products from line 20, 40 and 52 are directed to gas separators where the hydrogen gas and the hydrocarbon gases are separated. Hydrogen via lines 22 and 54 facilitates removal of the cracked gases from slurry 50. Liquid product is taken from the top of slurry 50 via line 56 and the slurry is passed to separator 58 where the dewaxing catalyst is returned to slurry 50 via line 60. Liquid product is obtained from separator 58 via line 62. The liquid product is substantially a fully converted dewaxed feedstock having a pour point of 20° F. or below.

A multistage ebullated bed reactor system would be substantially equivalent to the slurry reactor system shown in the FIGURE except that when utilizing an ebullated bed reactor, the liquid product obtained from the reactor should be substantially free if not completely free from catalyst particles as in the ebullated bed the catalyst would be more concentrated in the liquid at a point just above the catalyst support but absent from the liquid near the top portion of the column as opposed than to the uniformly dispersed catalyst within the slurry phase system.

Due to the small catalyst particle size required in a slurry phase reactor system, fixed-bed regeneration of the catalyst is not possible. However, the used catalyst may be regenerated utilizing a fluidized bed. In the ebullated bed system, the catalyst size is larger and assuming no significant attrition of the catalyst, a standard fixed-bed regeneration of the catalyst can be accomplished. It is believed however, that the aging rate of the catalyst is dramatically reduced by the advent of using the liquid phase reactors in the small size catalyst such that regeneration may not be required.

What is claimed:

1. A process for dewaxing a liquid hydrocarbon feedstock comprising dispersing within said liquid hydrocarbon feedstock a particulate solid dewaxing catalyst, said dewaxing catalyst freely movable within said liquid hydrocarbon feedstock and treating in a reaction zone said liquid hydrocarbon feedstock with said dewaxing catalyst dispersed therein under conditions of temperature and pressure sufficient to effect dewaxing of said liquid hydrocarbon feedstock, thereby also forming hydrocarbon gases in contact with said catalyst, and continuously removing said hydrocarbon gases from contact with said catalyst wherein said hydrocarbon gases are removed from contact with said catalyst by purging said gases from said liquid hydrocarbon feedstock with a hydrocarbon free gas.

2. The process of claim 1 wherein said dewaxing occurs at a temperature between about 500° and 1100° F., a space velocity between about 0.1 and 100 LHSV, a hydrogen-to-hydrocarbon mole ratio of about 0 to 20, and a pressure of about 100 to 3,000 psig, wherein said temperature of said reactor is uniform throughout said hydrodewaxing process.

3. The process of claim 1 wherein said hydrocarbon free gas is hydrogen.

4. The process of claim 1 wherein said liquid hydrocarbon feedstock boils in the range of 650° to 1300° F. and has a pour point of above about 80° F.

5. The process of claim 1 wherein said dewaxing catalyst is a shape selective zeolite having a constraint index of about 1 to 12.

6. The process of claim 5 wherein said zeolite is selected from the group consisting of ZSM-5, ZSM-11, ZSM-12, ZSM-23, ZSM-35, ZSM-38 and ZSM-48.

7. The process of claim 5 wherein said dewaxing catalyst is ZSM-5.

8. The process of claim 1 wherein said dewaxing catalyst is uniformly dispersed within the liquid hydrocarbon feedstock to form a slurry in the reaction zone.

9. The process of claim 8 wherein the reaction zone is a vertical column, said liquid hydrocarbon feedstock entering said column from the bottom thereof, said reaction zone including an open free space above said slurry whereby hydrocarbon gas which is formed during dewaxing is removed from said slurry into said free space.

10. The process of claim 8 wherein the particle size of said dewaxing catalyst ranges from about 0.001 to about 300 microns.

11. The process of claim 1 wherein said dewaxing catalyst is supported within said reaction zone but freely movable within said liquid hydrocarbon feedstock so as to provide a nonuniform distribution of catalyst within said liquid feedstock in said reaction zone, said catalyst being more concentrated in said feedstock at the vicinity of where said catalyst is supported and said catalyst being substantially absent from said liquid hydrocarbon feedstock at the point most remote from where said catalyst is supported.

12. The process of claim 11 wherein said reaction zone includes a free space above the liquid hydrocarbon feedstock.

13. The process of claim 11 wherein said dewaxing catalyst has a particle size of about 100 to about 3000 microns.

14. In a hydrodewaxing process for dewaxing a liquid hydrocarbon feedstock in which said liquid hydrocarbon feedstock, hydrogen and a particulate solid dewaxing catalyst are present in an intimate three-phase contacting relationship, said hydrodewaxing process being conducted under conditions of temperature and pressure sufficient to affect dewaxing of said liquid hydrocarbon feedstock, thereby also forming conversion products lighter than said liquid hydrocarbon feedstock in which said lighter conversion products compete with said heavier feedstocks for access to said dewaxing catalyst, the improvement comprising:

removing said lighter conversion products prior to contact with said dewaxing catalyst, said removing comprising purging a hydrocarbon free gas through said liquid hydrocarbon feedstock during said hydrodewaxing process.

* * * * *